US005504280A

United States Patent [19]

Woods

[11] Patent Number: 5,504,280

[45] Date of Patent: Apr. 2, 1996

[54] MUFFLER FOR MARINE ENGINES

[76] Inventor: Woodrow E. Woods, 3640 Fiscal Ct., Riviera Beach, Fla. 33404

[21] Appl. No.: 484,199

[22] Filed: Jun. 7, 1995

Related U.S. Application Data

[63] Continuation of Ser. No. 785,688, Oct. 31, 1991, abandoned.

[51] Int. Cl.[6] ..... F01N 7/12

[52] U.S. Cl. ..... 181/235; 181/264; 181/268

[58] Field of Search ..... 181/235, 233, 181/219, 236, 237, 241, 244, 247, 249, 250, 251, 255, 257, 260, 264, 265, 266, 268, 269, 277, 282, 283

[56] References Cited

U.S. PATENT DOCUMENTS 5,196,655 3/1993 Woods ..... 181/235

*Primary Examiner*—Michael L. Gellner
*Assistant Examiner*—Eddie C. Lee
*Attorney, Agent, or Firm*—Malin, Haley, DiMaggio & Crosby

[57] ABSTRACT

An improved muffler for silencing the exhaust emitted from a water cooled marine engine comprising a housing enclosure having a corrugated spacing means disposed within the housing partitioned by an angularly disposed inner planar baffle, the housing having an inlet for the exhaust gas and cooling water to fluidly communicate with a lower silencing chamber wherein the exhaust gas and cooling water are forced through a spacer passageway formed from the corrugated spacing means into an upper silencing chamber resulting in flow reversal and diminution in flow velocity so as to attenuate the exhaust noise, the exhaust gas and cooling water exiting the upper silencing chamber through an outlet fluidly communicated therewith and disposed collinearly with the input. The upper silencing chamber acting as a back flow preventor.

6 Claims, 4 Drawing Sheets

MUFFLER FOR MARINE ENGINES

This application is a continuation of application Ser. No. 07/785,688, filed Oct. 31, 1991, now abandoned.

BACKGROUND OF THE INVENTION

1. Field of the Invention

This invention relates generally to a muffler for quieting the exhaust from an internal combustion marine engine, and, more particularly, to an improved lift muffler which permits the exhaust outlet therefrom to be placed in line with, or at a lower level relative to, the exhaust inlet to widen the range of positions and applications in which a lift muffler may be used, and to provide a lift muffler having a reverse flow water surge protector.

2. Description of the Prior Art

The exhaust of the typical marine vessel is directed through either the drive system in an inboard/outboard unit or simply through the transom in a inboard drive setup. Both applications place the exhaust outlet near or below the water line leading to possible back flow situations when the exhaust gas does not present enough force to overcome a water surge, or where water enters the exhaust pipe while the engine is off. To prevent this back flow of water into the muffler or engine, a check valve or flapper valve is visually employed. However, flapper valves, having moving parts, quickly corrode and fail, leading to a potentially dangerous blockage of exhaust flow.

There are a variety of marine mufflers presently known in the art which are of the "axial flow" type such as the muffler disclosed in U.S. Pat. No. 4,167,987, issued to Turner. The Turner patent describes a multiple flow marine muffler wherein exhaust noise is attenuated by passing the exhaust gas through a series of longitudinally spaced opposing baffles. Although the device allows an in-line connection, such a configuration requires an elongated cylindrical shell to provide the required baffling effect, thus precluding application in tight-fit areas such as smaller boats or other situations where space is at a premium. The use of an axial flow muffler does not address the need to counter water surges. Also, axial flow mufflers cannot be placed below the water line without some form of surge suppression.

Another marine muffler, known as a "lift muffler," is disclosed in U.S. Pat. No. 3,296,997, issued to Hoiby, et al. The Hoiby muffler is essentially an up-right drum-shaped housing having an exhaust inlet near the top and a stand pipe exhaust outlet centrally located with its opening spaced above the drum bottom. The stand pipe directs the muffled exhaust gas and collected cooling water upwardly and outwardly to a location where it can be discharged from the boat without further back pressure. Such a device precludes application in tight-fit areas as the centrally located stand pipe requires exhaust conduit modifications to accommodate the pipe. Further, Hoiby does not present a means to prevent a reverse flow of water when the exhaust outlet is submerged.

Another type of marine muffler is disclosed in U.S. Pat. No. 4,917,640, issued to Miles. Miles teaches the use of a marine muffler wherein the engine exhaust is displaced between chambers through a series of parallel conduits transverse to the muffler body length. Cooling water from the exhaust manifold is entrapped at the bottom of the main chamber, a portion thereof remaining in the chamber, the remainder of which accompanies exhaust gas out of the muffler body. The exhaust noise is attenuated by baffling the exhaust gas through multiple chambers and in contacting the entrapped water. However, this type of muffler is not amenable to mounting within the boat hull without elaborate piping geometry so that the muffler can be fed at the top and evacuated at the bottom.

Muffler outlet placement close to, or beneath, the water line requires a means for preventing the back flow of water caused by water surges occasioned by water currents striking the transom. Conventional lift mufflers employ only a horizontal baffle which cannot counter cause the drain-off of surge water.

Therefore, there exists a need for a muffler capable of installation within a boat hull wherein the exhaust inlet and outlet may be situated at the same level to permit in-line placement thus providing the benefits of a lift muffler having an in-line hookup. Further, there exists a need to prevent back flow of water into a lift-type muffler without the addition of a check or flapper valve

SUMMARY OF THE INVENTION

The present invention provides an improved lift muffler for use with internal combustion marine engines. The muffler comprises a housing having a curved side wall joined by a top and bottom end which collectively define an internal chamber therein. A corrugated jacket or spacer is placed within the interior chamber and attached to the side wall of the housing chamber in a coaxial position. An impervious planar baffle is angularly disposed within this chamber and is sealingly attached to the jacket and the interior surface of the side wall of said housing thereby substantially partitioning the chamber into a lower and an upper silencing volume. The jacket and outer muffler housing together define a plurality of vertical passageways, the inner perimeter of the jacket structure being sealingly attached to the baffle. The jacket structure has an overall height less than the distance between the top and bottom ends of the housing, and fluidly communicates the upper and lower volumes. An exhaust inlet passageway for carrying exhaust gases and cooling water into the lower silencing volume extends inward from the side wall a nominal distance below the planar baffle. Mounted opposite thereto, preferably at the same vertical location if desired, is an outlet 7 passageway for evacuating exhaust gas and cooling water from the upper silencing volume mounted a nominal distance above the planar baffle.

The muffler functions by providing a first silencing volume generally separated from the outer wall of the muffler where a substantial quantity of energy is taken out of the exhaust gas flow. Exhaust gas is directed to the inlet of the device and into the first, or lower, silencing volume. Condensed cooling water, which originally had been mixed with the exhaust gas flowing from the engine to cool the exhaust gas, will accumulate at the bottom of the lower silencing volume which aids baffling and/or dampening of the exhaust sounds as well as reducing the operating temperature within the device. The corrugated walls provide a plurality of surfaces angled successively one from the other to further function as a sound absorbing acoustical barrier.

During operation, pressure elevated above ambient within the lower silencing volume forces the gas and vaporized water upward through the vertical passageways defined by the jacket and muffler housing and into the upper silencing volume where the flow is directed through the outlet passageway. The planar baffle functions as a sound absorbing acoustical barrier, as an inner wall for guiding the exhaust gas and cooling water to the outlet passageway, and as a surge protector for preventing the reverse flow of water into the engine by creating a ramp angled toward the outlet passageway.

In an alternative embodiment, the muffler comprises a first housing having a curved side wall joined by a top closure panel and bottom a bottom closure panel which collectively define an interior chamber therein. A second housing, or silencing chamber, is disposed within the first housing having a curved side wall with an upper closure panel and a lower aperture. An inlet pipe is attached to the silencing chamber extending through and attached to the first housing side wall. A spacer means is placed within the interior chamber attached to the side wall of the first housing positioning the silencing chamber in a centrally disposed position. The spacer means creates an exhaust passageway fluidly communicated with an aperture of the silencing chamber allowing exhaust gases to pass through the silencing chamber by way of the aperture to the spacer passageway for upward directional movement to a collection area for direction through the outlet. The silencing chamber functions as a sound absorbing acoustical barrier to guide the exhaust gas and cooling water to the spacer passageway, and as a surge protector for preventing the reverse flow of water into the engine as set forth above for the planar baffle.

In accordance with the present invention, it is an object thereof to provide an improved muffler for use with marine engines which permits installation within a minimal space in a boat hull.

It is an additional object of the instant invention to provide an improved lift muffler which allows placement of the inlet and outlet exhaust passageways at similar vertical positions relative to one another, thus allowing lower placement of the exhaust outlet relative to the water line without additional external piping.

It is still another object of the instant invention to provide a lift muffler having an angular baffle for directing matter from the upper volume of a lift muffler toward the exhaust outlet.

Still another object of the instant invention is to provide a corrugated spacer means to attenuate exhaust noise by use of a plurality of successively angled walls to cause destructive interference within the exhaust gas flow.

It is yet still another object of the instant invention to provide a device having the benefits of a stand pipe break in the exhaust flow path, similar to an in-line muffler, including a second break effectively operating as a surge protector.

In accordance with these and other objects which will become apparent hereinafter, the instant invention will now be described with particular reference to the accompanying drawings.

DETAILED DESCRIPTION OF THE PREFERRED EMBODIMENT

Figure 1:
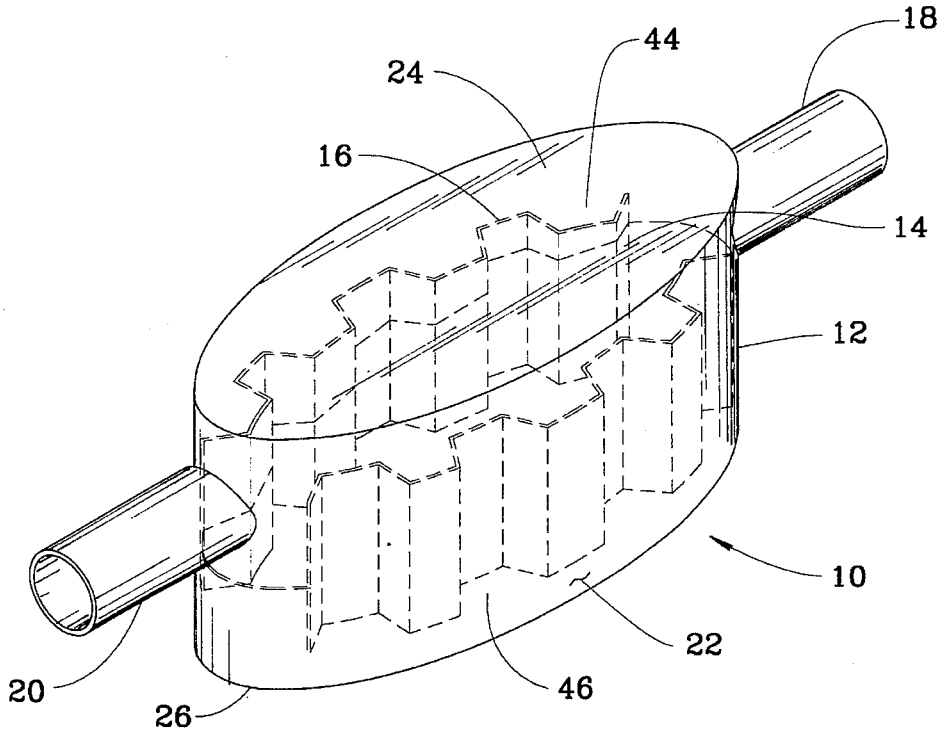
FIG. 1 is an isometric view of the muffler assembly of the instant invention showing interior detail in phantom.

With reference to FIGS. 1–4, there is depicted an improved lift muffler apparatus generally characterized by the reference numeral 10 which comprises a housing enclosure 12, a planar baffle 14, a corrugated spacer structure 16, and inlet and outlet passageways 18 and 20 respectively.

Figure 3:
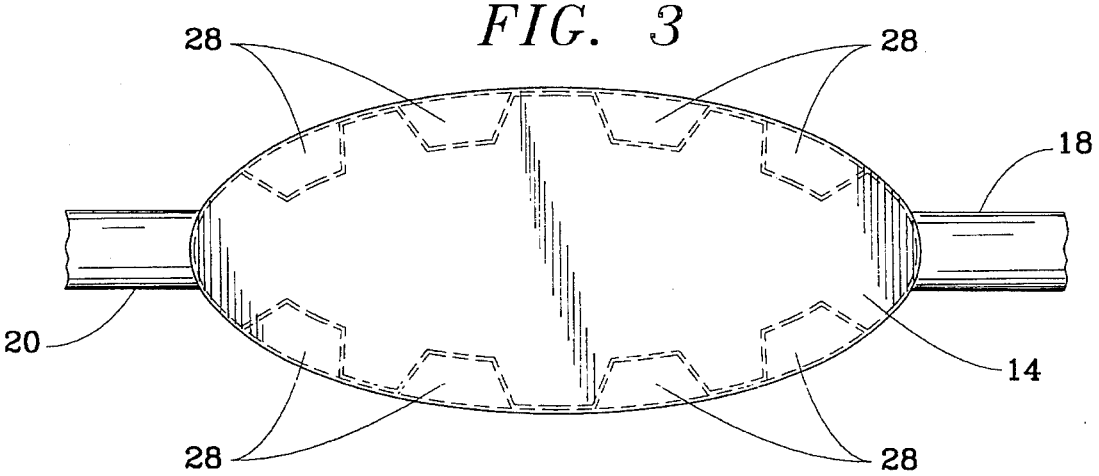
FIG. 3 is a top plan view of the muffler illustrating the jacket/housing side wall passageways.
Figure 4:
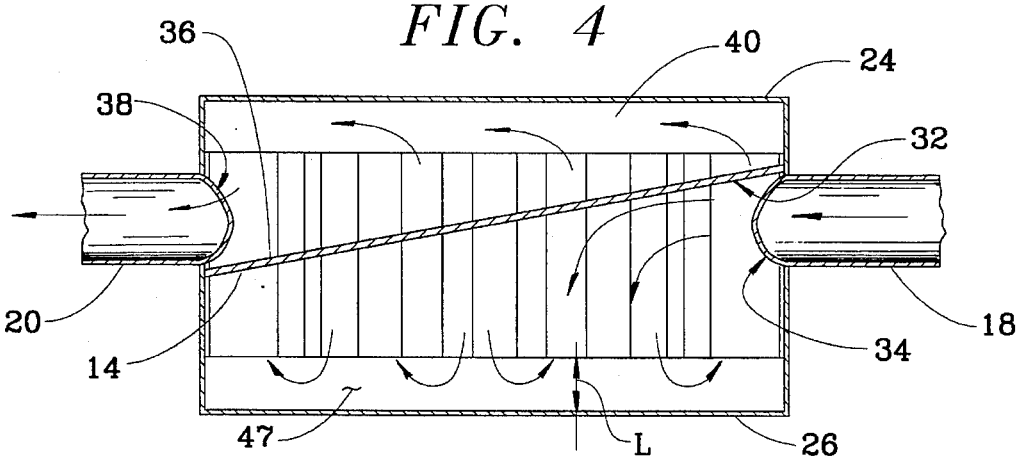
FIG. 4 is a cross-sectional side elevational view of the muffler.
Figure 2:
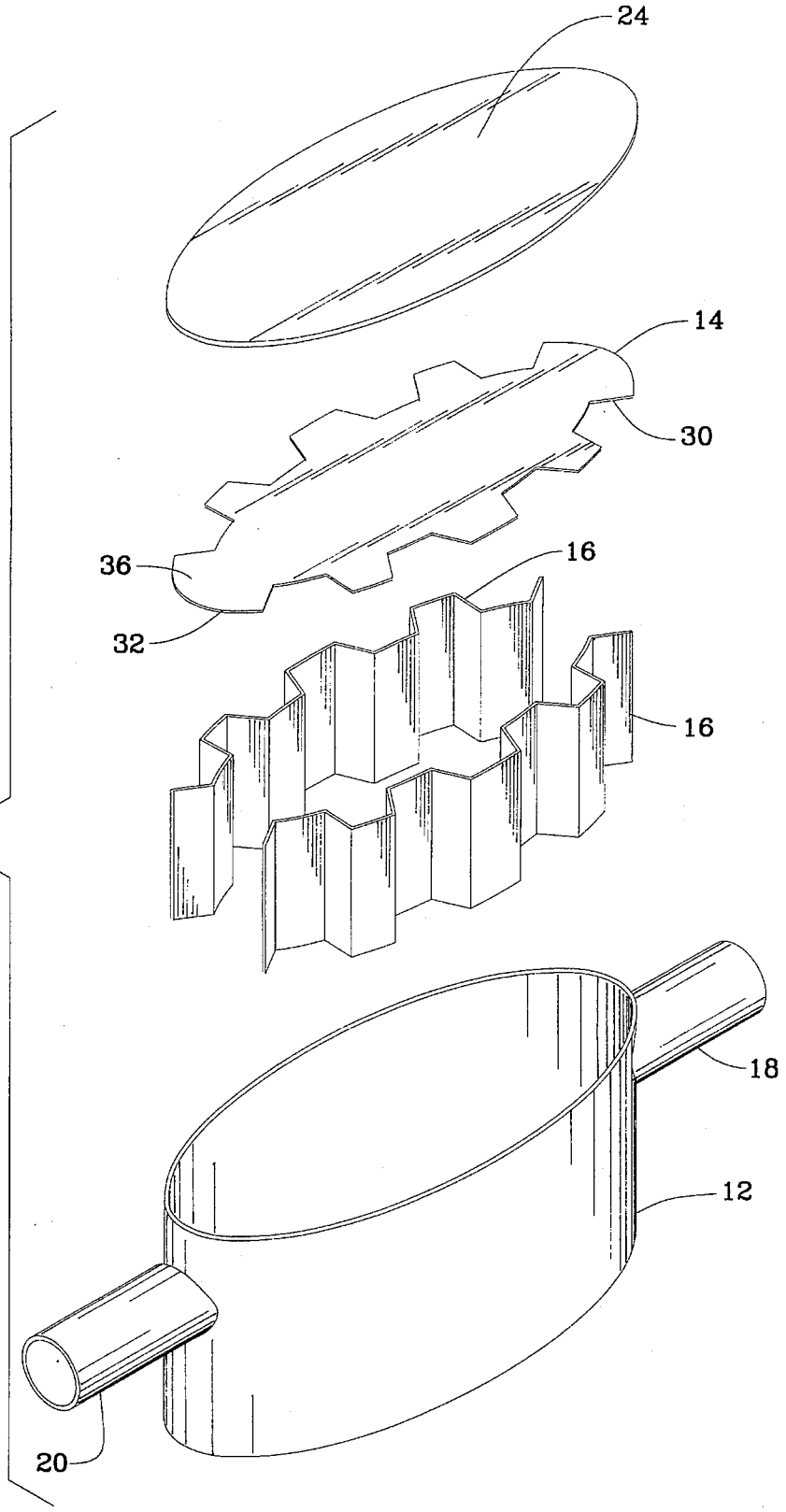
FIG. 2 is an exploded view of the muffler assembly of the instant invention.
Figure 6:
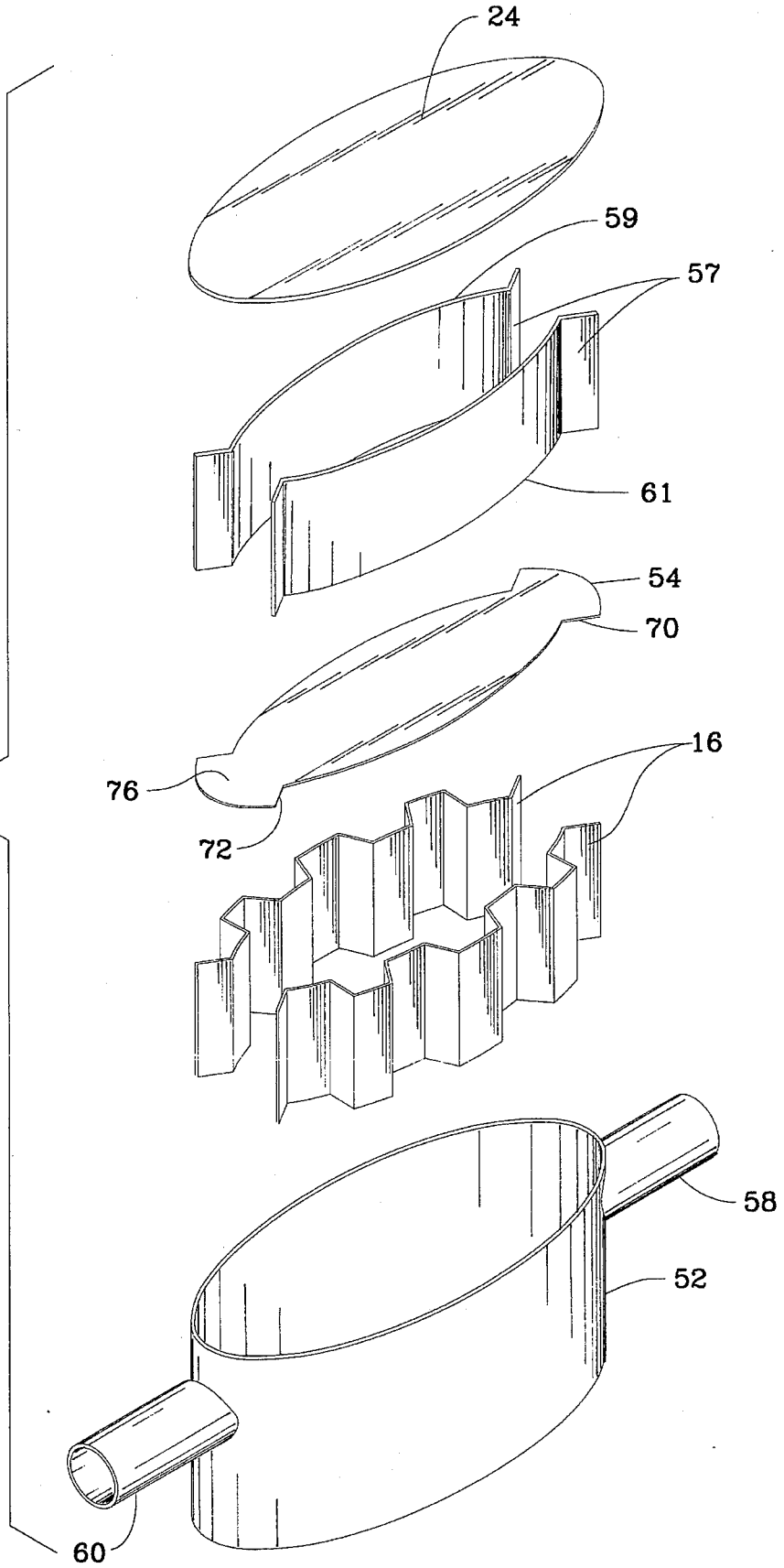
FIG. 6 is an exploded view of the muffler assembly of the instant invention incorporating the inner skin.
Figure 5:
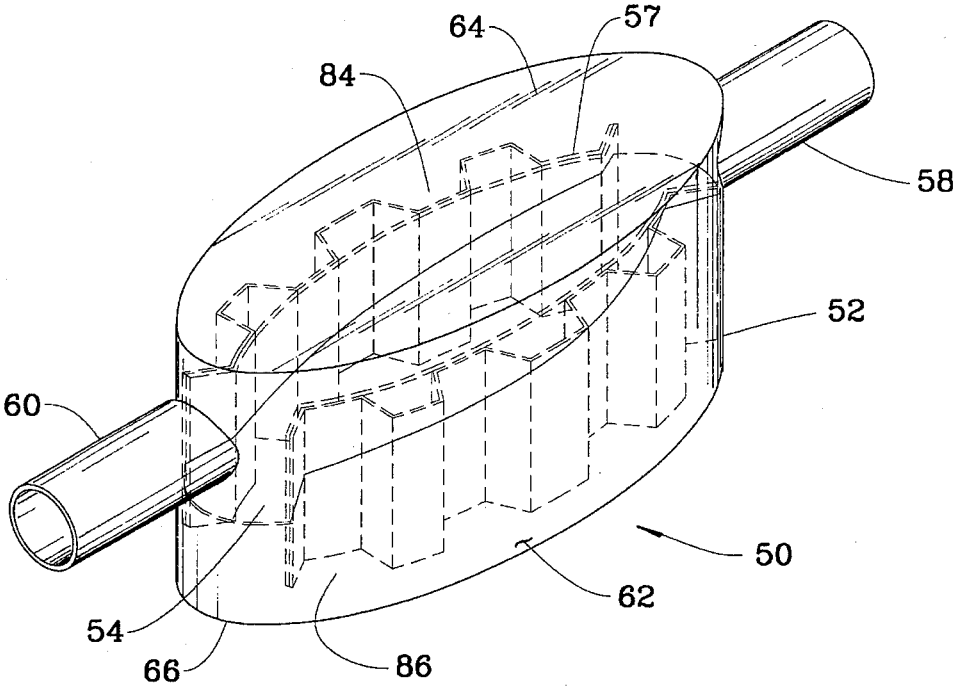
FIG. 5 is an isometric view of the muffler assembly of the instant invention incorporting the use of an inner skin illustrating the interior detail in phantom.

In this embodiment, housing 12 is a substantially cylindrical or elliptical enclosure defined by curved side wall 22, and top and bottom end panels 24 and 26 respectively. In order to facilitate assembly, housing 12 may be fabricated with either or both ends 24 and 26, being separate components which are sealably attached to side wall 22. The profile of wall 22 is generally cylindrical as best seen in FIG. 3, however, side wall 22 may be designed with a profile to accommodate space constraints within the boat hull depending on the particular application. Housing 12 is fabricated from, for example but not by way of limitation, fire retardant fiberglass, plastic, or from corrosion resistent metal.

Jacket-defined passageways 28 are formed from the corrugated structure 16 attached to the interior wall of said wall 22. Baffle 14 is an impervious planar member having an outer peripheral edge 30 which is adapted to be sealingly and rigidly attached to the of corrugated structure 16 and the interior surface of said side wall 22 at an angle $\alpha$ between 5° and 85°, preferably wherein the bottom surface 32 of the planar baffle 16 is slightly above inlet opening 34, and top surface 36 of the planar baffle 16 slightly below the outlet opening 38 relative thereto. Accordingly, outer peripheral edge 30 is elliptical with a corrugated edge when viewed normal to the planar surface of baffle 14.

Baffle 14 is rigidly secured to and sealed against corrugated structure 16 at outer peripheral edge 30 by means of attachment such as bonding, welding, or the like. Baffle 14 partitions housing 12 into separate air tight chambers characterized as upper and lower silencing volumes 40 and 42, respectively.

Jacket 16 defines a plurality of vertical openings 28 formed therefrom for communicating, and allowing the escape of, exhaust gas and cooling water from within lower silencing volume 42, to upper silencing volume 40. Passageways 28 are defined by the interior of side wall 22, each said passageways having an open top end 44 and an open bottom end 46. The periphery of jacket structure 16 rigidly and sealingly secured to baffle 14 by means of attachment such as bonding, sealant, or welding to prevent leakage therebetween such that the only means of passage between upper and lower silencing volumes 40 and 42 is through passageways 28. It is important to note that corrugated structure 16 may be constructed having section profiles other than corrugated, and still fall within the scope of the invention.

Inlet and outlet passageways 18 and 20, respectively, may be fabricated from fiberglass and molded integrally with housing 12. In the alternative, passageways 18 and 20 may be fabricated from metal and attached to housing 12 by, for example, bonding, welding or end flanges. Inlet and outlet passageways 18 and 20, respectively, can either be collinear or non-collinear with each other. For example, inlet conduit 18 may be disposed to communicate incoming exhaust gases through top closure panel 24 and baffle 14 with lower chamber 42. Also, outlet conduit 20 may be disposed so as to convey exhaust gases from upper chamber 40 through baffle 14 and lower closure panel 26.

Muffler 10 silences the exhaust gas from the internal combustion marine engine by directing high velocity exhaust gas, and cooling water injected and mixed therewith, through inlet passageway 18 into lower silencing volume 42. As the exhaust gas and cooling water mixture enters lower silencing volume 42, a portion of the cooling water condenses and will accumulate to a level of approximately L along the bottom end 26 of housing 12 which aids in heat transfer and noise dissipation. The energy of the escaping exhaust gas will force condensed cooling water to vaporize or otherwise be transported upwards through openings 46, through passageways 28, out of openings 44 and into silencing volume 40 where the gas and water may escape through outlet passageway 20 to an external volume. The corrugated structure 16 provides a plurality of non-collinear surfaces which function as a sound absorbing acoustical barrier. The angularly disposed planar baffle 14 further functions as an acoustical barrier by creating sonic reflections with the housing 22 which assist in dissipating the acoustical energy of the exhaust, and as a surge protector by protecting the reverse flow of water into the engine exhaust manifold by functioning as a ramp within upper silencing volume 40. The angular orientation of baffle 14 relative to housing side wall 22 additionally permits the lower placement of outlet passageway 20 relative to inlet passageway 18, so as to obviate the need for extraneous plumbing downstream of muffler 10, necessary in configurations wherein it is desirous to place the exhaust pipe at a lower level. Accordingly, less external exhaust piping is required, resulting in lower overall exhaust system back pressure and thus, higher engine efficiency.

Further, upper ends 44 of jacket 16 provides a fluid dam thereby preventing water flowing in from outlet 20 from passing into lower chamber 42.

With respect to FIGS 5–9, there is depicted the preferred embodiment of the improved lift muffler apparatus generally characterized by the reference numeral 50 which comprises a housing enclosure 52, a planar baffle 54, a corrugated spacer structure 56, inner partition 57 and inlet and outlet passageways 58 and 60 respectively.

Figure 7:
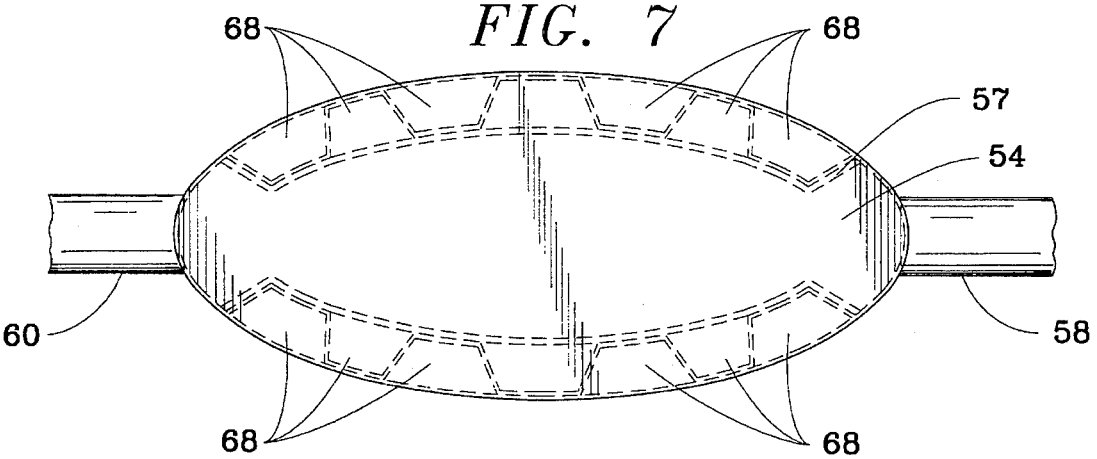
FIG. 7 is a top plan view of the muffler illustrating the jacket/housing side wall passageways.
Figure 8:
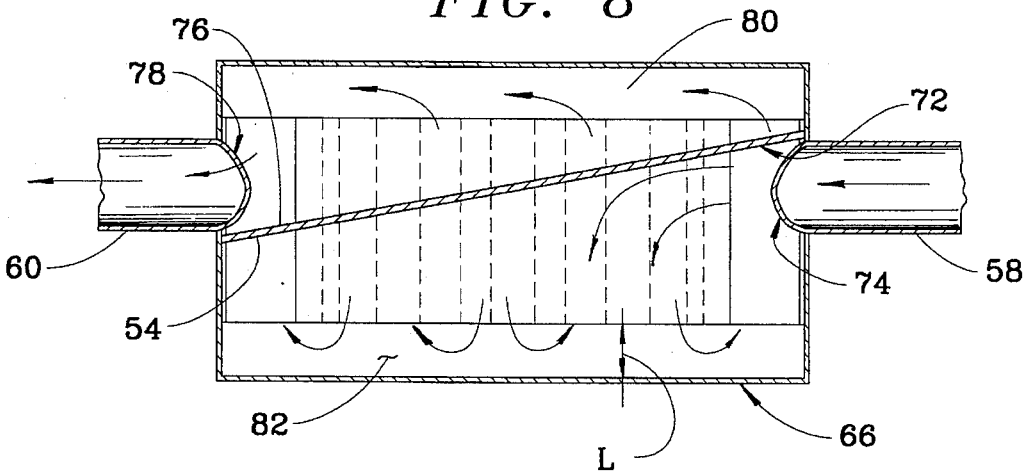
FIG. 8 is a cross-sectional side elevational view of the muffler.

In the preferred embodiment, housing 52 is a substantially cylindrical or elliptical enclosure defined by curved side wall 62, and top and bottom end panels 64 and 66 respectively. In order to facilitate assembly, housing 52 may be fabricated with either or both ends 64 and 66, being separate components which are sealably attached to side wall 62. The profile of wall 62 is generally cylindrical as best seen in FIG. 7, however, side wall 62 may be designed with a profile to accommodate space constraints within the boat hull depending on the particular application. Housing 52 is fabricated from, for example but not by way of limitation, fire retardant fiberglass, plastic, or from corrosion resistent metal.

Jacket-defined passageways 68 are formed from the corrugated structure 56 attached to the interior surface of wall 62. Inner partition 57 can then be attached to or disposed against corrugated structure 56 having a height defined by top edge 59 and bottom edge 61 and a length equal to the corrugated structure 56. Baffle 54 is an impervious planar member having an outer peripheral edge 70 which is adapted to be sealingly and rigidly attached to the inner partitions 57 and the interior surface of side wall 62 at an angle $\alpha$ between 5° and 85°, preferably wherein the bottom surface 72 of the planar baffle 56 is slightly above inlet opening 74, and top surface 76 of the planar baffle 56 slightly below the outlet opening 78 relative thereto. Accordingly, outer peripheral edge 70 is elliptical when viewed normal to the planar surface of baffle 54.

Baffle 54 is rigidly secured to and sealed against inner skins 57 at outer peripheral edge 70 by means of attachment such as bonding, welding, or the like. Baffle 54 substantially partitions housing 52 into separate air tight chambers characterized as upper and lower silencing volumes 80 and 82, respectively.

Inner partitions 57 and corrugated structures 56 define a plurality of vertical openings 68 formed therefrom for communicating, and allowing the escape of, exhaust gas and cooling water from within lower silencing volume 82, to upper silencing volume 80. Passageways 68 are defined by the interior of side wall 62, each said passageways having an open top end 84 and an open bottom end 86. It is important to note that corrugated structure 56 may be constructed having section profiles other than corrugated, and still fall within the scope of the invention.

Inlet and outlet passageways 58 and 60, respectively, may be fabricated from fiberglass and molded integrally with housing 52. In the alternative, passageways 58 and 60 may be fabricated from metal and attached to housing 52 by, for example, bonding, welding or end flanges.

Muffler 50 silences the exhaust gas from the internal combustion marine engine by directing high velocity exhaust gas, and cooling water injected and mixed therewith, through inlet passageway 58 into lower silencing volume 82. As the exhaust gas and cooling water mixture enters lower silencing volume 82, a portion of the cooling water condenses and will accumulate to a level of approximately L along the bottom end 66 of housing 52 which aids in heat transfer and noise dissipation. The energy of the escaping exhaust gas will force condensed cooling water to vaporize or otherwise be transported around lower edge 61 of inner skin 57 upwards through openings 86, through passageways 68, on either side of corrugated structure 56 out of openings 84 and into silencing volume 80 where the gas and water may escape through outlet passageway 60. The corrugated structure 56 provides a plurality of non-collinear surfaces which function as a sound absorbing acoustical barrier. The angularly disposed planar baffle 54 further functions as an acoustical barrier by creating sonic reflections with the housing 62 which assist in dissipating the acoustical energy of the exhaust, and as a surge protector by protecting the reverse flow of water into the engine exhaust manifold by functioning as a ramp within upper silencing volume 80. The angular orientation of baffle 54 relative to housing side wall 62 additionally permits the lower placement of outlet passageway 60 relative to inlet passageway 58, so as to obviate the need for extraneous plumbing downstream of muffler 50, necessary in configurations wherein it is desirous to place the exhaust pipe at a lower level. Accordingly, less external exhaust piping is required, resulting in lower overall exhaust system back pressure and thus, higher engine efficiency.

Further, upper edge 59 of inner partition 57 provides a fluid dam thereby preventing water flowing in from outlet 60 from passing into lower chamber 82.

Alternatively, a second embodiment may be employed wherein a silencing chamber comprised of a substantially circular sidewall having an inlet sealably attached to the side wall with an upper closure panel formed from a planer baffle angularly attached to said sidewall, and a open bottom or aperture therethrough, can be adapted to be rigidly connected within the confines of the housing described above. The inlet pipe can be sealed to the side wall of the housing by welding, bonding, or the like. A spacer means is slidably insertable into the housing against the side wall positioning the silencing chamber in a centrally disposed position. The spacer can be formed from a corrugated insert as described above or a similar reticulated insert, or by any other shape that provides a means for securing the silencing chamber in a fixed position and further provide a vertical passageway for exhaust gas passage. The corrugated structure provides a means for rigidly biasing the silencing chamber against the housing surface without the need of permanent fastening thereto.

In this alternative embodiment the exhaust gas from the internal combustion marine engine and cooling water injected and mixed therewith is directed through the inlet passageway and into the silencing chamber. The energy of the escaping exhaust gas is forced through the spacer passageway forcing the remaining differential volume of cooling water to vaporize and be transported upwards and into the upper silencing volume where the gas and water may collect and escape through the outlet passageway in a similar manner to that described in the preferred embodiment.

The instant invention has been shown and described herein in what is considered to be the most practical and preferred embodiments. It is recognized, however, that departures may be made therefrom within the scope of the invention and that obvious modifications will occur to a person skilled in the art.

What I claim is:

1. A muffler for a marine engine comprising:

a means for housing comprised of a curved side wall having an interior surface, an exterior surface, a top closure panel and a bottom closure panel; said curved side wall sealingly connected to said top closure panel and said bottom closure panel thereby defining an interior chamber therein;

an impervious means for baffling which defines an outer peripheral edge, said means for baffling disposed within said interior chamber at an angle between 5 and 85 degrees with respect to the horizontal, said means for baffling defining an upper silencing volume and a lower silencing volume within said interior chamber;

at least one corrugated spacer, said at least one spacer channeling exhaust gas between said upper and lower silencing volumes, thereby fluidly communicating said upper and lower silencing volumes, said at least one corrugated spacer positioned between said interior surface of the housing and said outer peripheral edge of said means for baffling;

an inlet, said inlet fluidly communicating said lower silencing volume with a source of exhaust gas flow;

an outlet, said outlet fluidly communicating said upper silencing volume with an external volume.

2. The muffler recited in claim 1, wherein said side wall defines an elliptical section when viewed normal to said top and bottom closure panels.

3. The muffler recited in claim 1, wherein said means inlet is disposed collinearly with said outlet.

4. The muffler recited in claim 1, wherein said inlet is disposed non-collinearly with said outlet.

5. The muffler recited in claim 1, wherein said means for housing is fabricated from fiberglass.

6. The muffler recited in claim 1, wherein said means for housing is fabricated from corrosion resistant metal.

* * * * *